United States Patent [19]

Phillips

[11] Patent Number: 4,779,599

[45] Date of Patent: Oct. 25, 1988

[54] HYDRAULIC MECHANISM

[75] Inventor: Ronald Phillips, Northolt, England

[73] Assignee: Lucas Industries public limited company, England

[21] Appl. No.: 703,423

[22] Filed: Feb. 20, 1985

[30] Foreign Application Priority Data

Mar. 9, 1984 [GB] United Kingdom ..... 8406271

[51] Int. Cl.[4] ..... F02M 39/00

[52] U.S. Cl. ..... 123/506; 123/447

[58] Field of Search ..... 123/385, 447, 386, 387, 123/198 D, 198 DB, 506, 446, 458, 467

[56] References Cited

U.S. PATENT DOCUMENTS

| | | | |
|---|---|---|---|
| 2,177,120 | 10/1939 | Schaeren | 123/387 |
| 3,093,117 | 6/1963 | Brown | 121/38 |
| 3,540,213 | 11/1970 | Johnston | 60/1 |
| 3,614,946 | 10/1971 | Staudt | 123/387 |
| 3,930,484 | 1/1976 | Skinner | 123/387 |
| 4,296,718 | 10/1981 | Baugh | 123/387 |
| 4,470,397 | 9/1984 | Brotherstton | 123/198 D |
| 4,512,307 | 4/1985 | Igashira | 123/198 D |
| 4,546,749 | 10/1985 | Igashira | 123/506 |

*Primary Examiner*—Carl Stuart Miller

[57] ABSTRACT

An hydraulic mechanism constructed to facilitate termination of fuel delivery by a fuel injection pump includes a piston slidable within a bore which opens into a chamber communicating with the pump. The piston is biased towards an end wall of the chamber and in the end wall is an inlet port. The piston defines a sealing surface engaging with the end wall about the port and a control valve connects the port with the chamber. When the valve is closed and the piston is in contact with the end wall fuel can be delivered by the pump but as soon as the valve is opened the piston is displaced away from the end wall to absorb the fuel delivered by the pump.

7 Claims, 2 Drawing Sheets

HYDRAULIC MECHANISM

Figure 1:
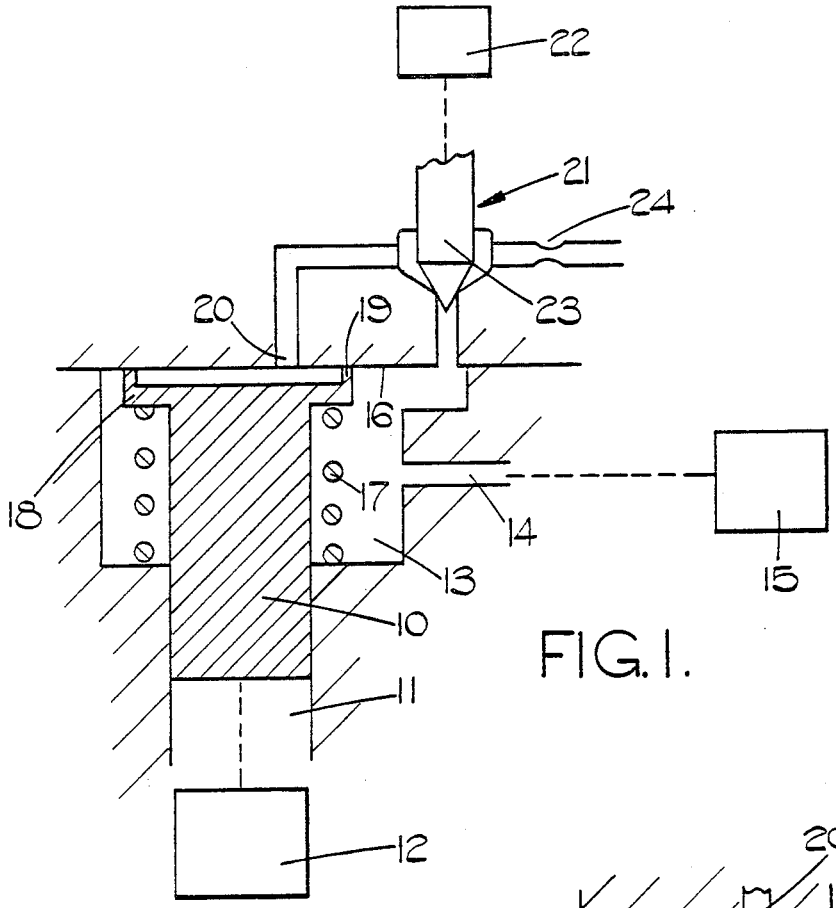

This invention relates to a hydraulic mechanism including a piston member movable in a bore and a control valve operable in use to apply liquid under pressure to the piston to cause movement of the piston in one direction in the bore.

In one example of such a mechanism the piston acts as an actuator for effecting movement of a member such for example as a valve member, which it is required to move quickly from one position to another. In this case the control valve which may be for example electromagnetically actuated, must have in the open position, a flow area which is sufficiently large taking into account the pressure of liquid, to allow the piston to move its prescribed distance in the time required. In the closed position of the control valve the area of the valve element of the control valve, exposed to the pressure of liquid should be as low as possible in order to minimise the power required to operate the control valve. It is not easy to design a control valve which will fulfil the two conditions set out.

Another example of the mechanism is where the piston movement is not itself used for actuation purposes but where the volume of the bore is required to increase suddenly by displacement of the piston, so as to create a storage space for a volume of liquid. An application for such a mechanism exists in a fuel pumping apparatus for supplying fuel to an internal combustion engine where the output of a high pressure pump supplying fuel through an outlet to an engine is suddenly diverted from the outlet to a low pressure space. The aforesaid control valve can be used for this purpose but again it is difficult to design a control valve which will fulfil the two conditions set out.

The object of the present invention is to provide a hydraulic mechanism of the kind specified in a simple and convenient form.

According to the invention a hydraulic mechanism of the kind specified comprises a piston member movable in a bore, a control valve operable in use to apply liquid under pressure to the piston to cause movement of the piston in one direction in the bore, a chamber at one end of the bore, an end wall to said chamber, an inlet port in said end wall, a seating surface defined on said piston for engagement with the surface of said end wall surrounding said inlet port, passage means communicating the liquid under pressure to said chamber, said control valve being operable to supply liquid under pressure to said inlet port, and means biasing the piston towards said end wall, the arrangement being such that when said seating surface is in contact with said end wall, the forces acting on said piston will maintain said surface in contact with the end wall but when said control valve is operated the liquid under pressure applied through said inlet port to the area of the end of the piston member enclosed by said seating surface will be sufficient to effect movement of the piston member in said one direction away from said end wall.

Figure 2:
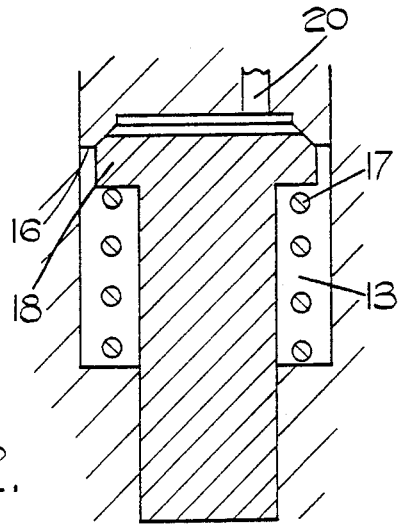
Figure 3:
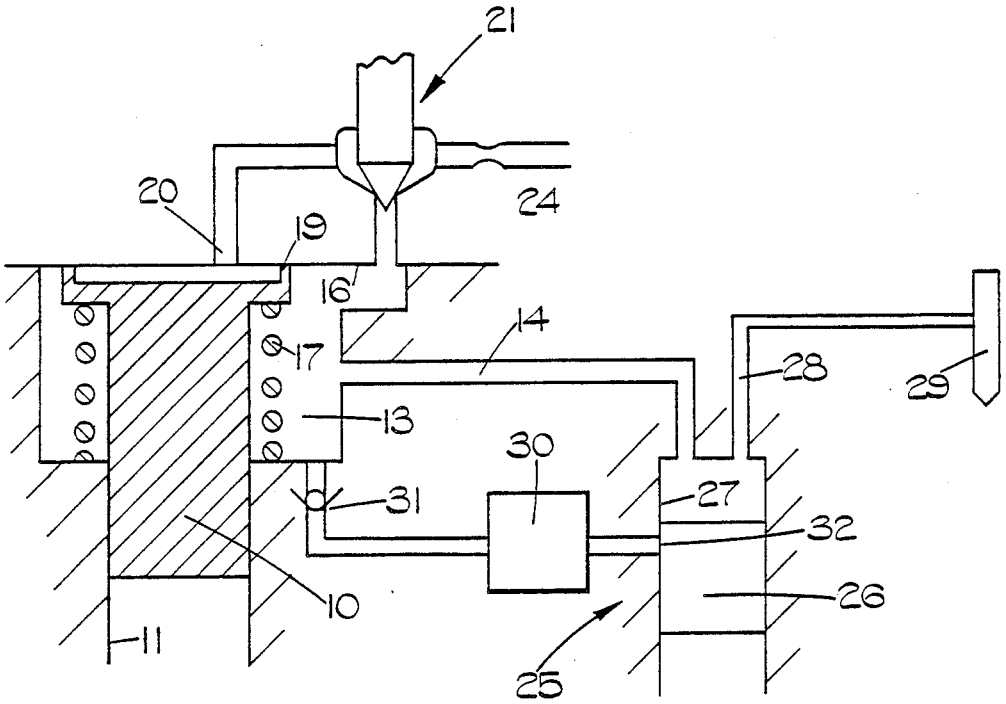

In the accompanying drawings:

FIG. 1 is a diagrammatic representation of one example of a hydraulic mechanism in accordance with the invention, FIG. 2 shows a modification to part of the mechanism of FIG. 1, and FIG. 3 shows the application of the hydraulic mechanism to a fuel injection pump.

Referring to FIG. 1 of the drawings there is provided a piston 10 which is slidably located in a bore 11, the piston 10 being connected to some mechanism indicated at 12 which is required to be actuated. The bore 11 opens at one end into a chamber 13 which is connected through a passage 14 to a source 15 of liquid under pressure. The piston is lightly biased towards an end wall 16 of the chamber by means of a coiled compression spring 17 which conveniently is located within the chamber but may be exterior thereof.

The end of the piston presented to the end wall is provided with a flange in which is formed a recess whereby the flange defines a seating surface 19 for engagement with the end wall 16. Opening into the end wall of the chamber is an control port 20 which is connected by way of a control valve generally indicated at 21, with the source 15 of liquid under pressure. The control valve is conveniently actuated by an electromagnetic actuator 22 and it includes a valve element 23 movable by the actuator to prevent flow of liquid under pressure to the port 20. Conveniently the valve is a needle valve having a seating with which the valve element co-operates and when the valve element is closed as illustrated, the port 20 communicates with a drain by way of restrictor 24.

In the closed position of the control valve 21 as shown and with the seating surface 19 pressed against the end wall of the chamber, the forces acting on the piston maintain the piston against the end wall 16. The forces acting on the piston are due to the force exerted by the spring 17 and the unbalanced force due to the liquid pressure acting on the annular area of the flange exposed to the liquid pressure in the chamber. The pressure in the aforesaid recess is low as compared with the pressure of liquid in the chamber 13.

When the control valve 21 is opened liquid under pressure from the chamber flows to the aforesaid recess and raises the pressure therein. This pressure acts on the piston over an area which is effectively equal to the area of the bore 11 and the piston is moved against the action of the spring 17. As soon as the seating surface 19 is lifted from the end wall of the bore the liquid pressure in the chamber acts on the aforesaid area of the piston, it being appreciated that the pressure of liquid in the recess prior to movement of the piston, may be slightly less than the pressure in the chamber due to the restrictive nature of the control valve and the restrictor 24. When the liquid pressure in the chamber acts on the piston, the piston is moved rapidly away from the end wall 16 and the movement of the piston is not hindered by the restrictive nature of the control valve 21. The valve 21 can therefore be designed so that its valve element 23 in the closed position has a very low area subjected to the pressure of liquid supplied by the source 15. As a result the force required to hold the control valve closed will be very small.

When the piston has moved its maximum extent against the action of the spring 17, it can only be returned by temporarily cutting off the supply of liquid to the chamber. As the piston moves back toward the end wall 16 of the chamber, liquid will be displaced from the chamber and this can flow from the chamber through the restrictor 24 or if the passage 14 is provided with a suitable control valve, the liquid can vent through the passage 14 to a low pressure drain.

In the example described the liquid pressure in the chamber is utilised to assist the action of the spring 17 in maintaining the piston in contact with the end wall 16 when the control valve is closed. With the arrangement described the spring 17 can be omitted so that only liquid pressure is utilised to maintain the piston against the end wall. Alternatively, the flange can be omitted but in this case the spring must be provided to maintain the piston in contact with the end wall when the control valve is closed. The area of the recess must be such that the force exerted when the control valve is opened, is sufficient to move the piston against any hydraulic or mechanical forces.

A modification essentially to the shape of the piston member is seen in FIG. 2 and in this case it will be seen that the sealing surface is defined by a truncated conical surface formed on the flange 18 of the piston and the surface co-operates with a complementary surface formed about a recess which is defined in the end wall 16 of the chamber.

Turning now to FIG. 3, there is illustrated how the hydraulic mechanism indicated in FIG. 1, can be used in conjunction with a fuel injection pump for supplying fuel to an internal combustion engine. Parts of the hydraulic mechanism which have the same function as those in FIG. 1, are provided with the same reference numeral. In FIG. 3, the fuel injection pump is indicated at 25 and it includes a pumping plunger 26 which is reciprocable within a bore 27 under the action of for example an engine driven cam lobe which drives the plunger towards one end of the bore from which extends an outlet 28 connected in use to a fuel injection nozzle 29 of an associated engine. The passage 14 also communicates with the aforesaid end of the bore and the chamber 13 is connected to a source 30 of liquid fuel at low pressure, by way of a non-return valve 31 which can lift to allow fuel flow into the chamber 13. During inward movement of the plunger towards said one end of the bore, fuel will be displaced from the bore 27 through the outlet 28 to the injection nozzle 29 so long as the control valve 21 remains closed and the seating surface 19 on the piston 10 is in contact with the end wall 16.

When during the inward movement of the plunger it is required to halt the supply of fuel to the injection nozzle, the control valve 21 is opened and the fuel under pressure flows through the port 20 to lift the seating surface 19 away from the end wall 16. As soon as this happens the pressure in the chamber 13 moves the piston away from the end wall 16 of the chamber against the action of the spring 17 and this results in a rapid reduction in the pressure of fuel supplied to the injection nozzle. A valve in the injection nozzle closes and further flow of fuel to the engine ceases. When the pumping plunger 26 has moved inwardly its maximum extent and starts to move outwardly the pressure in the chamber 13 falls and the piston returns under the action of the spring 17 towards the end wall 16. In so doing, fuel is displaced back to the bore 27 but since some fuel will have been lost from the system due to the fact that some fuel will have been supplied through the injection nozzle and some fuel will have been lost by way of the restrictor 24, the valve 31 opens to allow the fuel to be replenished from the source 30. The pressure of fuel supplied by the source must not be so high as to prevent the piston 10 moving under the action of the spring 17 and the displacement of the piston 10 must be greater than that of the pumping plunger 26.

If desired, the valve 31 and the direct connection from the source of liquid to the chamber 13 can be replaced by a filling port 32 formed in the wall of the bore 27, the port 32 being uncovered by the plunger near the outermost limit of its travel. It may be desirable however to provide the port 32 and also the passage and its valve 31.

I claim:

1. A liquid fuel pumping apparatus for supplying fuel to an internal combustion engine comprising a piston movable in a bore, said piston having a body and a flange surrounding said body, said flange extending outward from said body and defining a surface, a fluid accumulator chamber at one end of the bore and into which the piston can move, an end wall to said accumulator chamber, biasing means engaging said flange and biasing the piston toward contact with said end wall with predetermined biasing force, a control port in said end wall, a seating surface defined on said piston for engagement with said end wall surrounding said control port, said control port being arranged so that fluid in said control port acts on said plunger to cause an accumulator chamber opening force on said piston which is in a direction to force said piston away from contact with said end wall, a reciprocable pumping plunger slidable in a cylinder, an outlet from said cylinder, the outlet in use communicating with a fuel injection nozzle of an internal combustion engine, passage means connecting said cylinder with the accumulator chamber to fluidically connect said chamber and said cylinder so that fluid pressure in said cylinder is communicated to said chamber to establish a first chamber pressure, a low pressure pump for supplying liquid fuel to said cylinder, with said first chamber pressure acting on said flange surface in co-operation with said biasing means so that said predetermined biasing force and said first chamber pressure cooperate to form a combined accumulator chamber closing force on said piston which exceeds said accumulator chamber opening force to maintain said piston seating surface in contact with said end wall, said first chamber pressure being such that fluid from said cylinder flows through said outlet, valve means for controlling the flow of fuel into the cylinder during outward movement of the plunger, and a control valve means operable to connect said control port to the chamber, the arrangement being such that during inward movement of the pumping plunger and with the piston seating surface in contact with the end wall, the pressure in said chamber will be said first chamber pressure and fuel will be displaced through said outlet until said control valve means is operated, whereupon the pressure of fuel in the chamber will act upon the area of the end of the piston enclosed by the seating surface to increase said accumulator chamber opening force to a second value, with the area enclosed by said seating surface being sized so that said accumulator chamber opening force second value exceeds the combined accumulator chamber closing force to move the piston away from said end wall to lower the pressure in said accumulator chamber to a second pressure which is below that of the pressure in the outlet so that fuel from the cylinder will flow into the accumulator chamber rather than to the outlet, said piston moving outwardly of the chamber, the outward movement of the piston causing the accumulator chamber to absorb the further fuel displaced by the plunger after operation of the control valve means to accumulate such further fuel in said accumulator chamber to terminate the flow of fuel through the outlet.

2. An apparatus according to claim 1 including a recess defined between said end wall and the piston, said recess comunicating with said control port.

3. An apparatus according to claim 1 including a restrictor connecting said control port with a drain.

4. An apparatus according to claim 2 in which said recess is defined in the piston.

5. An apparatus according to claim 2 in which said recess is defined in said end wall, said piston defining a truncated conical seating surface, a complementary surface being defined in said end wall about said recess.

6. An apparatus according to claim 1 in which said valve means comprises a non-return valve which opens to allow flow of liquid from the low pressure pump during outward movement of the plunger.

7. An apparatus according to claim 1 in which said valve means comprises a feed port in the wall of the cylinder, said feed port being covered by the pumping plunger during the inward movement thereof.

* * * * *